United States Patent [19]

Hashimoto

[11] Patent Number: 4,557,291

[45] Date of Patent: Dec. 10, 1985

[54] MULTIPLE CONTROL VALVE SYSTEM

[75] Inventor: Yutaka Hashimoto, Ayase, Japan

[73] Assignee: Toshiba Kikai Kabushiki Kaisha, Tokyo, Japan

[21] Appl. No.: 654,035

[22] Filed: Sep. 21, 1984

Related U.S. Application Data

[63] Continuation of Ser. No. 336,268, Dec. 31, 1981, abandoned.

[30] Foreign Application Priority Data

Jan. 13, 1981 [JP] Japan ..... 56-3414

[51] Int. Cl.[4] ..... F15B 13/08

[52] U.S. Cl. ..... 137/596.13; 91/530

[58] Field of Search ..... 91/530; 137/596.13

[56] References Cited

U.S. PATENT DOCUMENTS 3,150,685 9/1964 Lohbauer et al. ..... 137/596.13

4,178,962 12/1979 Tennis ..... 137/569.13

*Primary Examiner*—Gerald A. Michalsky

*Attorney, Agent, or Firm*—Koda and Androlia

[57] ABSTRACT

A multiple control valve system comprises a multiple control valve as a main body, an additional attachment valve operatively connected to the multiple control valve, a logic valve oil-tightly fitted to the multiple control valve so as to be communicated with oil passages formed in the multiple control valve, and a change-over valve operatively connected to a spool located in the attachment valve so as to be communicated with oil passages of the attachment valve and connected to the logic valve through a conduit.

1 Claim, 3 Drawing Figures

MULTIPLE CONTROL VALVE SYSTEM

This is a continuation of application Ser. No. 336,268, filed Dec. 31, 1981, now abandoned.

BACKGROUND OF THE INVENTION

This invention relates to an improvement of a multiple control valve system which comprises a multiple control valve and valve means attached thereto.

Various types or forms of multiple control valves have been widely used and known in the art of this field, and a typical example of these valves will be described hereunder in conjunction with FIG. 1. FIG. 1 shows a multiple control valve 11 having a plurality of spools for changing flow direction of an oil passing through the multiple control valve in which a valve body 12 is provided with an inlet chamber 13 into which a pressurized oil is supplied from an external oil source through a pump 14. The pressurized oil is discharged, under an unloaded condition, into a drain tank 19 through a by-pass passage 18 formed at the central portions of the valve body 12 to be opened by spools 15 and 17 when the spools 15 and 17 occupy their neutral positions as shown in FIG. 1. The pressurized oil is also supplied to the spools 15 and 17 in communication with side passages 20 and 21 connected to and extending from the inlet chamber 13.

When a spool 16 is moved rightwardly as viewed in FIG. 1, the by-pass passage 18 is closed by an enlarged central portion and outer surface of the spool 16 and the side passage 20 comes to communicate with a hole 22 provided for the spool 16, whereby the pressurized oil is guided to one hydraulic chamber located on one side of an actuator, not shown, which hydraulically operates through an axial hole, not shown, of the spool 16, a hole 23, and a cylinder port 24. A pressurized oil in the other hydraulic chamber on the other side of the actuator flows into the tank 19 through a cylinder port 25, holes 26, 27, and a return passage 28.

In a case where a multiple control valve such as shown in FIG. 1 is incorporated in a civil machine, for example a bulldozer, the spools 15 and 17 of the control valve 11 are operatively connected to a travelling motor and actuators of a bucket and a boom, respectively. A recent civil machine is often provided with a hydraulic breaker as an attachment member in addition to the travelling motor and the actuators of the bucket and the boom.

One example of such a multiple control valve is shown in FIG. 2 in which like reference numerals are applied to elements corresponding to those shown in FIG. 1 or a capital letter "A" is added thereto, and the multiple control valve provided with an additional valve is referred to as a multiple control valve system hereunder.

A multiple control valve 11A shown in FIG. 2 is different from that 11 shown in FIG. 1 in that an inlet chamber 13A of a valve body 12A does not communicate with side passages 20A and 21A, which are connected to a pump 14 through conduits 31 and 33. The valve body 35 of a valve 34 (called an attachment valve 34 hereinbelow) attached to the valve 11A is provided with an inlet chamber 36 which is connected to a drain tank 19 through the pump 14. When the spool 37 of the attachment valve 34 occupies its neutral position as shown in FIG. 2, pressurized oil supplied to the inlet chamber 36 flows into the inlet chamber 13A of the multiple control valve 11A through a by-pass passage 38, a central portion of the spool 37, and a pipe 39 which is communicated with the inlet chamber 13A, and then the pressurized oil is discharged into the tank 19 where the spools 15 and 17 occupy their neutral positions.

In the meantime, when the spool 16 of the valve 11A is moved rightwardly as viewed in FIG. 2, as described in connection with FIG. 1, the by-pass passage 18 is closed and the pressurized oil entered into the passage 20A is fed into one hydraulic chamber located on one side of an external actuator, not shown, which hydraulically operates, through holes 22, 23 and the cylinder port 24. The pressurized oil in the other hydraulic chamber on the other side of the actuator is discharged into the tank 19 through the cylinder port 25, holes 26, 27, and the passage 28. When the spool 37 of the attachment valve 34 is moved rightwardly, the pressurized oil in the inlet chamber 36 is fed to one hydraulic chamber located on one side of an actuator, not shown, which operates hydraulically, through a side passage 40, holes 41, 42, 43, and a cylinder port 44 and the pressurized oil in the other hydraulic chamber on the other side of the actuator is discharged into the tank 19 through a cylinder port 45, holes 46, 47, 48, and a return passage 49.

With the multiple control valve system shown in FIG. 2, the valve body 12A of the multiple control valve 12A is different from the valve body 12 of the valve 11 in their constructions because the conduits 31 and 32 are connected to the valve body 12A, so that it is impossible to apply a usual multiple control valve as shown in FIG. 1 as it is to a multiple control valve system as shown in FIG. 2 and it is obliged to manufacture independently the valve body 12A without utilizing the valve body 12. This inconvenience results in the increase in the manufacturing cost as well as manufacturing steps.

SUMMARY OF THE INVENTION

An object of this invention is to provide an improved multiple control valve system capable of utilizing an ordinary multiple control valve and an additional valve to be attached to the multiple control valve without using conduits connecting the valve body of the multiple control valve and an oil source, the use of such conduits making impossible to utilize an ordinary multiple control valve as it is.

According to this invention, there is provided a multiple control valve system of the type comprisng a multiple control valve having an oil inlet chamber connected to an external pressurized oil source, oil passages connected to the oil inlet chamber, and a plurality of spools for changing over flow direction of the pressurized oil passing through the oil passages and an additional attachment valve operatively connected to the multiple control valve and having an oil inlet chamber connected to the external pressurized oil source, oil passages connected to the oil inlet chamber of said attachment valve, and a spool for changing over flow direction of the pressurized oil passing through the oil passages of the attachment valve, and the multiple control valve system further comprises a logic valve oil-tightly attached to the multiple control valve so as to be communicated with the oil passages formed in the multiple control valve and a change-over valve operatively connected to the spool of said attachment valve so as to be communicated with the oil passages of the attachment valve and connected to the logic valve through a conduit.

DESCRIPTION OF THE PREFERRED EMBODIMENTS

Figure 1:
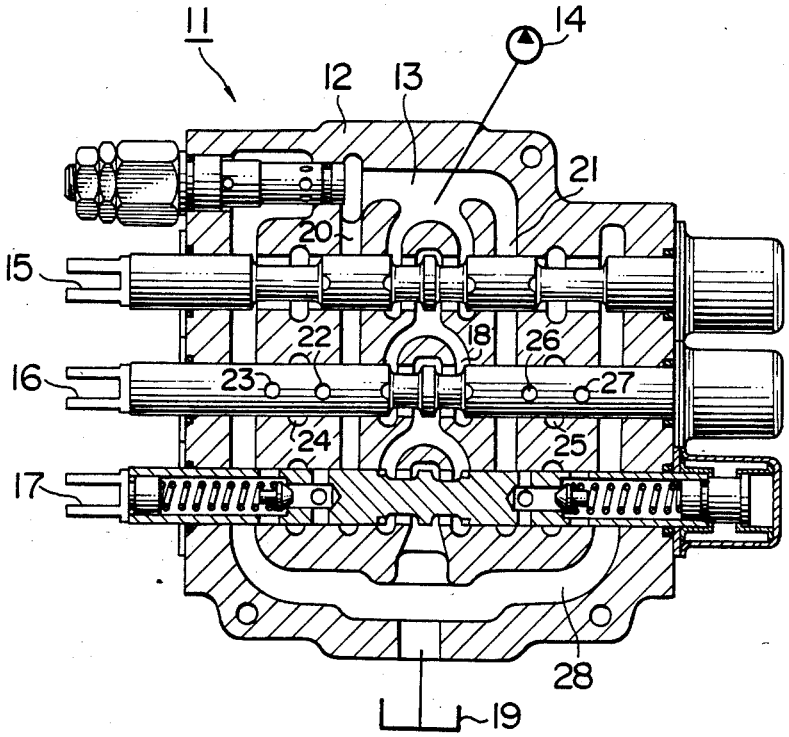
FIG. 1 PRIOR ART
FIG. 1 shows a longitudinal section of a known type multiple control valve.
Figure 2:
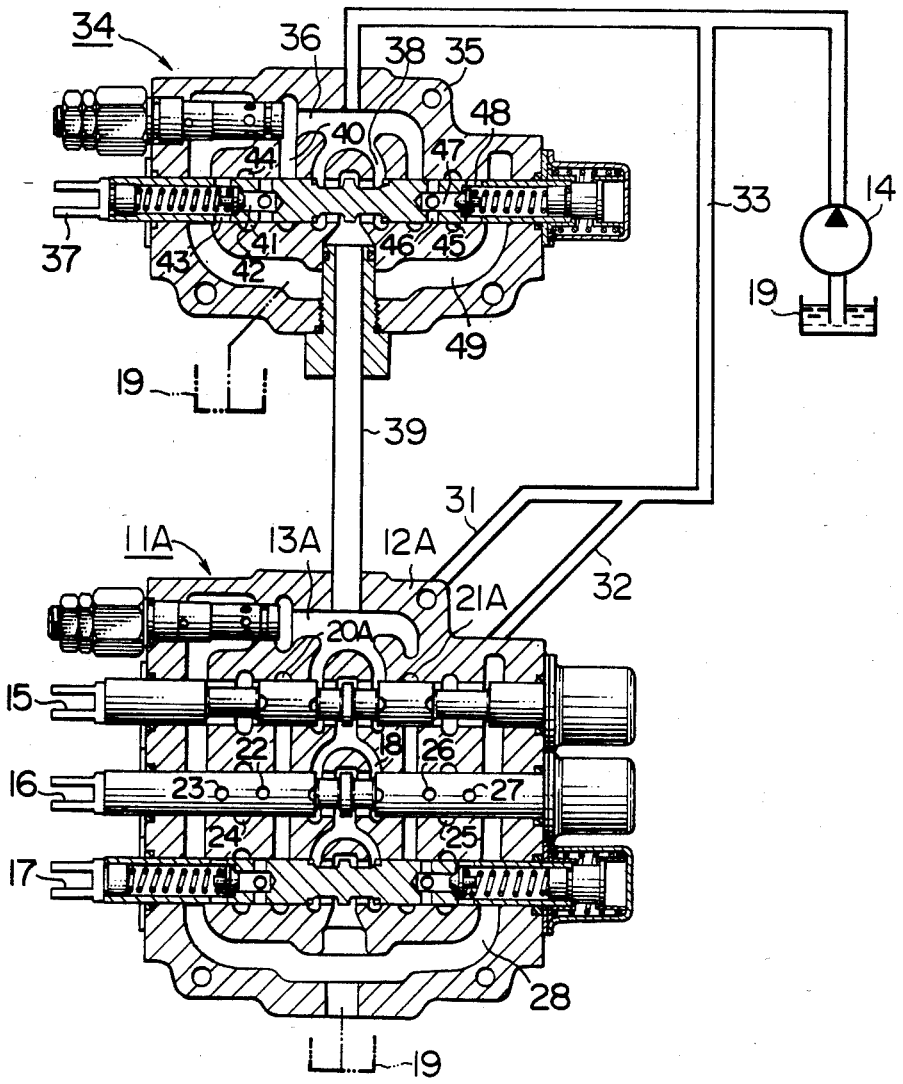
FIG. 2 PRIOR ART
FIG. 2 shows a longitudinal section of a known type multiple control valve system.
Figure 3:
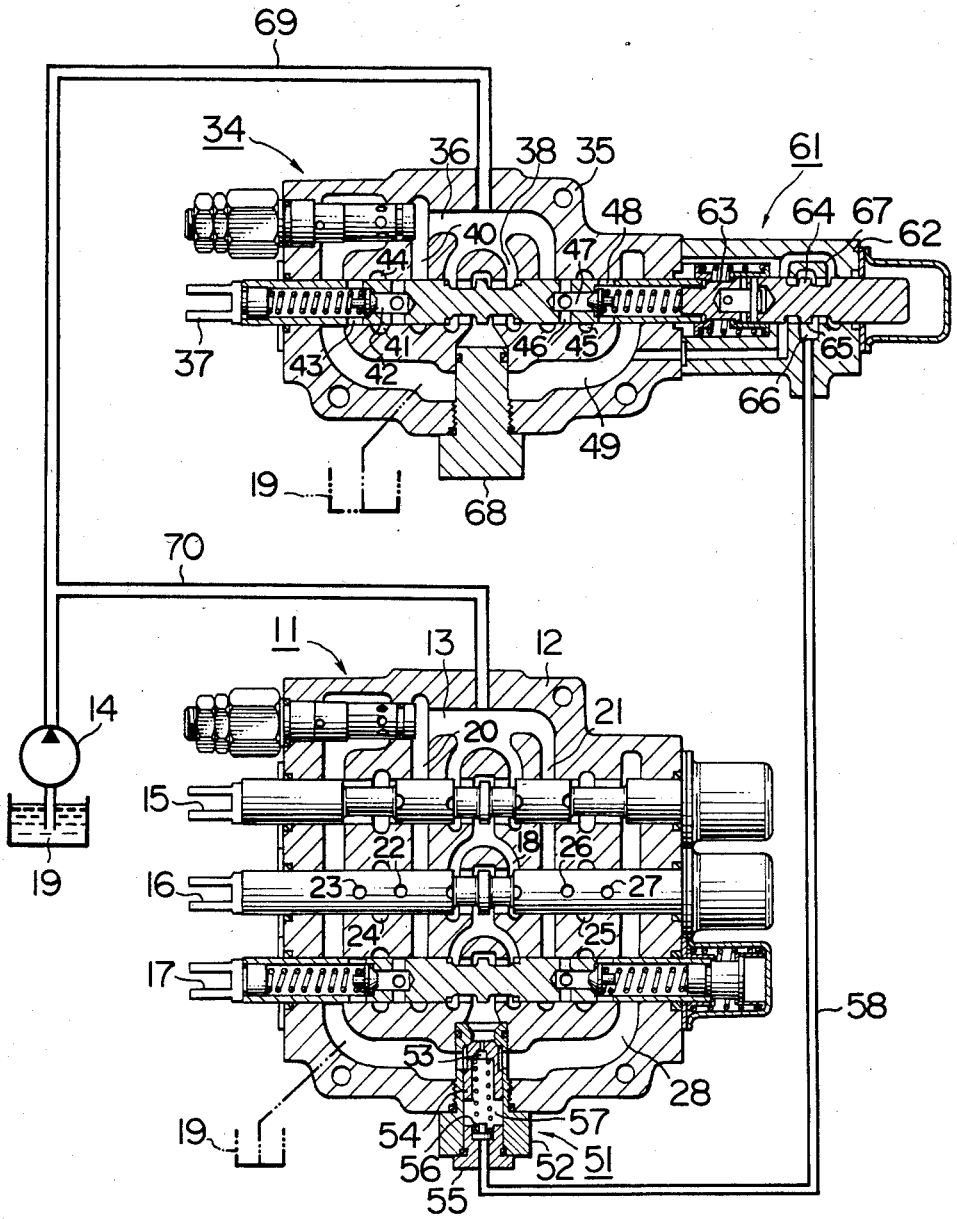
FIG. 3 shows a longitudinal section of an embodiment of a multiple control valve system according to this invention.

FIG. 3 shows one embodiment of a multiple control valve system according to this invention, in which like reference numerals are applied to elements corresponding to those shown in FIGS. 1 and 2 and the corresponding elements shown in FIG. 3 operate in substantially the same manner as described with reference to FIG. 2.

A logic valve 51 which controls a loaded or unloaded condition due to the pressurized oil passing through the by-pass passage 18 or the return passage 28 is mounted on the downstream side of the by-pass passage 18 in the multiple control valve 11. The logic valve 51 comprises a hollow valve body 52 which is water-tightly attached to the valve body 12 and a spool 54 which is to be inserted into the valve body 52 and is provided with a hole 53 at the front end. The spool 54 is always urged upwardly as viewed in FIG. 3 by a spring 56 having one end engaging a plug 55 which is inserted into the lower end of the hollow valve body 52. A pilot chamber 57 is formed within the valve body 52 between the plug 55 and the lower end of the spool 54 and the pilot chamber 57 is communicated with a conduit 58 through the plug 55.

A pilot change-over valve 61 is attached to one end (righthand end in FIG. 3) of the spool 37 of the attachment valve 34. The change-over valve 61 has a cylindrical member 62 water-tightly attached to the valve body 35, and a valve member 64 secured to the spool 37 through a joint member 63 is inserted into the cylindrical member 62 which is provided with a pilot port 66 surrounding a land portion 65 of the valve member 64 and communicated with the conduit 58. Thus, the pilot change-over valve 61 and the logic valve 51 are operatively connected to each other through the conduit 58. A passage 67 which is connected to the return passage 49 of the valve body 35 is formed on both sides of the pilot port 66.

In the multiple control valve system described above, the inlet chambers 13 and 36 of the multiple control valve 11 and the attachment valve 34 are connected respectively to the pump 14 through the conduits 70 and 69 which are parallelly arranged.

The multiple control valve system according to this invention operates as follows.

When the spool 37 of the attachment valve 34 and the spools 15 and 17 of the multiple control valve 11 are positioned in their neutral positions, pressurized oil is supplied from the tank 19 into the inlet chamber 36 of the attachment valve through the conduit 69 and then flows into the by-pass passages 38 which are blocked by the plug 68. In the meantime, the pressurized oil supplied from the tank 19 enters into the inlet chamber 13 of the multiple control valve 11 through the conduit 70 and then flows into the by-pass passage 18. At this time, the pilot chamber 57 of the logic valve 51 is connected to the tank 19 through the conduit 58, the passage 67 of the pilot change-over valve 61, and the return passage 49 of the attachment valve 34, so that the spool 54 of the logic valve 51 is lowered by the pressure applied on the upper surface of the spool 54 against the urging force of the spring 56, whereby the by-pass passage 18 is communicated with the return passage 28 and the pressurized oil is discharged into the tank 19.

When the spool 16 of the multiple control valve 11 is moved rightwardly while maintaining the spool 37 of the attachment valve 34 at its neutral position, the by-pass passage 18 is closed and the pressurized oil enters into one hydraulic chamber of the external actuator, not shown, through the side passage 20, the holes 22, 23, and the cylinder port 24. The pressurized oil in the other hydraulic chamber of the actuator flows into the tank 19 through the cylinder port 25, the holes 26, 27, and the return passage 28. When the spool 37 of the valve 34 is moved rightwardly, the valve member 64 of the change-over valve 61 attached thereto also moves rightwardly and the communication between the pilot port 66 and the passage 67 is shut out. Namely, because the connection between the pilot chamber 57 of the logic valve 51 and the tank 19 is shut out, the pressurized oil passing through the hole 53 of the spool 54 acts on the downstream portion of the spool 54. The cross-sectional area of the lower portion of the spool 54 is larger than that of the upper portion thereof, so that the spool 54 rises and shuts out the communication between the by-pass passage 18 and the return passage 28, whereby the hydraulic pressure in the inlet chamber of the attachment valve 34 rises, and the pressurized oil in the chamber 36 flows into one hydraulic chamber of an external actuator, not shown, through the side passage 40, the holes 41, 42, 43, and the cylinder port 44. At this time, the pressurized oil in the other hydraulic chamber of the actuator flows into the tank 19 through the cylinder port 45, the holes 46, 47, 48, and the return passage 49.

According to the multiple control valve system of this invention, where the attachment valve 34 is in its neutral position, the logic valve 51 secured to the downstream portion of the by-pass passage 18 of the usual multiple control valve 11 is opened thereby to maintain the unloaded condition of the multiple control valve assembly. On the other hand, in a case where the attachment valve 34 is in its operative position, the pilot change-over valve 61 connected to the spool 37 of the attachment valve 34 operates so as to shut out the logic valve 51 to maintain the loaded condition and to actuate an actuator connected to cylinder ports 44, 45 of the attachment valve 34.

The multiple control valve systems of this invention can utilize valve bodies of usual multiple control valves without the necessity of newly manufacturing them and using additional conduits or pipes, whereby the multiple control valve system is economically manufactured and the manufacturing steps can be reduced.

What is claimed is:

1. A multiple control valve system comprising:

a multiple control valve having an oil inlet chamber connected to an external pressurized oil source, oil passages inclusive of a center by-pass passage and a side passage, connected to said oil inlet chamber, a plurality of spools for communicating an upstream side of said center by-pass passage with a downstream side thereof at a neutral position of the spool and throttling said center by-pass passage during the movement in a direction towards and away from the neutral position of the spool and for changing over flow direction of the pressurized oil passing through said side passage, and a return passage for said pressurized oil;

an additional attachment valve operatively connected to said multiple control valve and having an oil inlet chamber connected to said external pressurized oil source, oil passages connected to said oil inlet chamber of said attachment valve, a return passage, and a spool for changing over flow direction of the pressurized oil passing through said oil passages of said attachment valve, said inlet chambers of said multiple control valve and said attachment valve being parallelly connected to said pressurized oil source;

a logic valve oil-tightingly attached to said multiple control valve in a tandem manner with respect to said center by-pass passage so as to communicate with said oil passages formed in said multiple control valve at a position between said downstream side of said center by-pass passage and said return passage of said multiple control valve for controlling the communication with said oil passages by the operation of said attachment valve; and a changeover valve provided with a portion connected to said spool of said attachment valve so as to communicate with said return passage of said attachment valve and connected to said logic valve through a conduit so that a pilot chamber of said logic valve is connected to an oil tank at the neutral position of the spool and the connection between said pilot chamber and said oil tank is interrupted at a position other than the neutral position of the spool.

* * * * *